United States Patent [19]

Swiderski

[11] 4,124,998

[45] Nov. 14, 1978

[54] AIR CONDITIONING SYSTEMS FOR BUILDINGS

[75] Inventor: Kazimierz Swiderski, Don Mills, Canada

[73] Assignee: Canada Square Management Ltd., Toronto, Canada

[21] Appl. No.: 762,074

[22] Filed: Jan. 24, 1977

[30] Foreign Application Priority Data

Feb. 3, 1976 [CA] Canada ..... 244860

[51] Int. Cl.[2] ..... F25D 13/02; F25B 7/00

[52] U.S. Cl. ..... 62/442; 62/79

[58] Field of Search ..... 62/79, 410, 411, 412, 62/238, 442, 324, 325, 335

[56] References Cited

U.S. PATENT DOCUMENTS

| | | | |
|---|---|---|---|
| 2,718,766 | 9/1955 | Imperatore et al. | 62/79 |
| 2,975,609 | 3/1961 | Allander et al. | 62/442 |
| 3,247,678 | 4/1966 | Mohlman | 62/442 |
| 4,024,728 | 5/1977 | Gustafsson | 62/79 |

*Primary Examiner*—Lloyd L. King

*Attorney, Agent, or Firm*—Rogers, Bereskin & Parr

[57] ABSTRACT

An air conditioning system for a building having a building cooling load is described. The system includes a cooling circuit for a cooling fluid. The building cooling load is connected in the circuit. The circuit includes means for circulating the cooling fluid unidirectionally in the circuit and through the building cooling load, and means for cooling the fluid. The system also includes means for delivering fresh air to the building, including an inlet duct having a outer end communicating with ambient air outside the building, and means for drawing air into the building through the duct. The cooling circuit includes a heat transfer coil connected in the circuit upstream of the cooling means and defining a fluid flow path for the cooling fluid. The coil is arranged in the fresh air inlet duct so as to allow heat energy transfer between air in the duct and fluid in the coil. The coil has respective first and second ends spaced longitudinally of the duct with the second end closer to the outer end of the duct than the first end. The circuit further includes fluid flow crossover means associated with the coil. The crossover means is operable to cause cooling fluid to flow either in a forward direction from said first end of the coil to said second end or in a reverse direction from said second end of the coil to said first end. Accordingly, in conditions of low temperature ambient air, the fluid can be circulated through the coil in said reverse direction in order to minimize the overall heat loss from the cooling fluid to the incoming air as the fluid travels from end to end of the coil.

5 Claims, 1 Drawing Figure

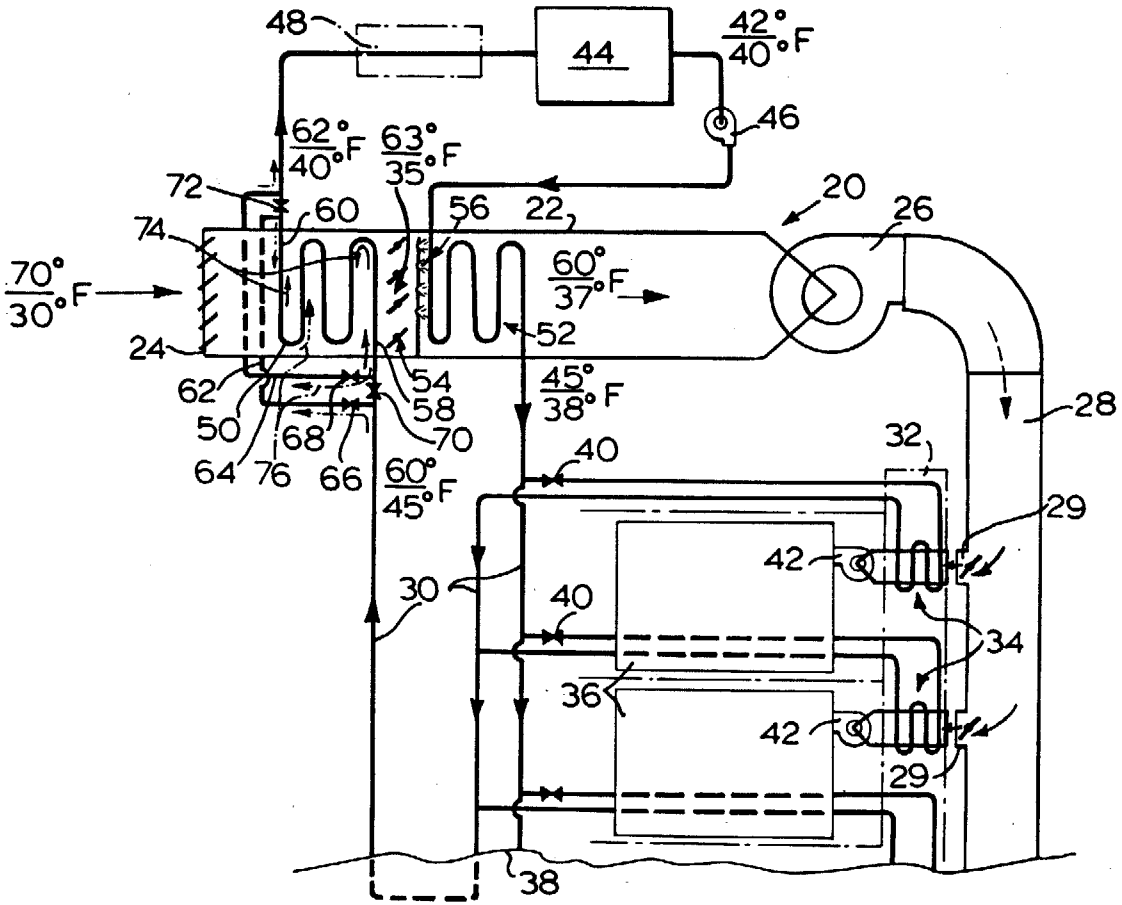
20
22
24
26
28
29
30
32
34
36
38
40
42
44
46
48
50
52
54
56
58
60
62
64
66
68
70
72
74
76
42°/40°F
62°/40°F
63°/35°F
60°/37°F
45°/38°F
60°/45°F
70°/30°F

AIR CONDITIONING SYSTEMS FOR BUILDINGS

This invention relates to air conditioning systems for buildings.

Air conditioning systems in multi-storey buildings may include both a cooling circuit for recirculating a cooling fluid through the building and means for supplying conditioned fresh air to the interior of the building. The fresh air is drawn into the building through an inlet duct and is delivered to the occupied space in the building by one or more fan units. The air inlet duct normally forms part of an air conditioning unit on the roof of the building.

The cooling circuit may include heat transfer coils arranged in the air inlet duct of the air conditioning unit so that incoming air passes successively over the coils. Heat energy is transferred between the cooling fluid in the coils and the air. In hot weather, this causes the incoming fresh air to be cooled by the coils. In cold weather the cooling fluid will normally be warmer than the incoming air, causing a consequent increase in the temperature of the air. In this connection it should be noted that the core areas of multi-storey office buildings normally require year round cooling whilst the peripheral areas have variable heating/cooling requirements.

A problem with air conditioning systems of this kind is that there is a tendency for the cooling water in the outermost coil in the air duct to freeze during cold weather, with consequent disruption of cooling service and possible damage to the system.

An object of the present invention is to provide improvements in air conditioning systems for buildings.

According to the invention there is provided an air conditioning system for a building having a building cooling load. The system includes a cooling circuit for a cooling fluid. The building cooling load is connected in the circuit. The circuit includes means for circulating the cooling fluid unidirectionally in the circuit and through the building cooling load, and means for cooling the fluid. The system also includes means for delivering fresh air to the building, including an inlet duct having an outer end communicating with ambient air outside the building, and means for drawing air into the building through the duct. The cooling circuit further includes a heat transfer coil connected in the circuit upstream of the cooling means and defining a fluid flow path for the cooling fluid. The coil is arranged in the fresh air inlet duct so as to allow heat energy transfer between air in the duct and fluid in the coil. The coil has respective first and second ends spaced longitudinally of the duct with the second end closer to the outer end of the duct than the first end. The circuit further includes fluid crossover means associated with the coil. The crossover means is operable to cause cooling fluid to flow either in a forward direction from said first end of the coil to said second end or in a reverse direction from said second end of the coil to said first end. Accordingly, in conditions of low temperature ambient air, the fluid can be circulated through the coil in said reverse direction in order to minimize the overall heat loss from the cooling fluid to the incoming air as the fluid travels from end to end of the coil.

The invention will be better understood by reference to the accompanying drawing which is a diagrammatic illustration of an air conditioning system according to one embodiment of the invention in a multi-storey building.

The system shown in the drawing includes a cooling circuit for recirculating a cooling fluid (water) through the cooling load of the building, and means for delivering ambient (fresh) air to the occupied spaced of the building. Incoming fresh air passes through an air conditioning unit located on the roof of the building.

In the drawings, numeral 20 denotes such an air conditioning unit. The unit includes an air inlet duct 22 which has an outer end 24 communicating with ambient air outside the building. At its inner end, duct 22 communicates with a fan unit 26 arranged, when operated, to draw ambient air into the duct 24 and to deliver it into a vertical air duct 28 which serves various zones of the building. A zone may include occupied space on part of the same floor or on more than one floor of the building. In any event, air from duct 28 is delivered to a plenum 29 associated with each zone.

As indicated above, the cooling circuit of the building utilizes water as the cooling fluid. In the drawing, numeral 30 denotes pipes in which the cooling water flows. The building cooling load is indicated generally by a box 32 drawn in chain line. In the illustrated embodiment the majority of the cooling load is represented by cooling coils 34 shown in two adjacent zones of the building. Numerals 36 represent the occupied spaces of the two zones in question. As indicated by the break line 38, other similar occupied spaces will normally be present in other zones of the building; each such occupied space may be considered as having its own cooling coil 34. The cooling coils 34 are parallel connected and have associated valves 40 so that individual coils can be isolated from the cooling circuit.

Each of the occupied spaces 36 communicates with the associated plenum 29 so that conditioned fresh air from the fan unit 26 can be delivered to each of the occupied spaces. Each space also includes its own individual fan unit 42 for circulating air from the plenum 29 (fresh air and return air from the occupied space).

The cooling circuit also includes a chiller 44 for cooling the water in the circuit and suitable pumps, a typical one of which is indicated at 46. The cooling circuit may be coupled to a heat energy storage reservoir by way of a heat exchanger such as that indicated in chain line at 48. Systems incorporating energy storage reservoirs are disclosed in Canadian Pat. applications Nos. 227,111 and 227,215 both filed May 16, 1975 in the name of Canada Square Management Limited. However, heat energy storage reservoirs form no part of the present invention and will not therefore be described in this application.

Two heat transfer coils 50 and 52, both connected in the cooling circuit, are located in the fresh air inlet duct 22 of the air conditioning unit 20. Coil 50 is connected in the circuit upstream of the chiller 44 and coil 52 is connected in the circuit downstream of the chiller, both considered in the direction of water flow as indicated by the arrows in the drawing. Adjustable deflectors generally indicated at 54 are provided in the air inlet duct 22 so that incoming air flowing over the coil 50 can either be allowed to also flow over coil 52, or can be caused to bypass that coil according to air conditioning requirements. Water sprays 56 are also provided in the air duct 22 for applying moisture to coil 52 for humidity control purposes as is well known in the art.

As can be seen, the coil 50 is located upstream with respect to the coil 52 in the direction of air flow along duct 22. Coil 50 has first and second ends denoted respectively 58 and 60 which are spaced longitudinally of the duct 22, the second end 60 being closer to the outer end 24 of the duct than the first end 58. Associated with coil 50 in the cooling circuit are crossover connections denoted 62 and 64 which bypass coil 50. As can be seen, connection 62 is coupled to the pipes 30 of the cooling circuit upstream of the connection 64 at both the input and the output side of coil 50. Each of the connections 62 and 64 includes a shut-off valve 66 and 68 respectively. Similar valves 70 and 72 are provided between the two connections at the input and output sides respectively of the coil 50.

It will be appreciated that, by appropriately setting the valves 66 to 72, water circulating in the cooling circuit can be caused to flow through the coil 50 selectively in the direction from the first end 58 to the second end 60 of the coil (hereinafter called the forward direction) or in the opposite direction from the second end 60 to the first end 58 (hereinafter called the reverse direction). If valves 66 and 68 are closed and valves 70 and 72 are open the water will flow in the forward direction as indicated by the solid arrows 74 in the drawing. On the other hand, if valves 70 and 72 are closed and valves 66, 68 are open the water will flow in the reverse direction as indicated by the chain line arrows 76. With the valves so arranged, water approaching the coil will flow along the bypass connection 62 and will enter the coil at its second end 60. On leaving the first end 58 of the coil, the flow will be returned to the circuit along connection 64 at the output side of the coil.

The crossover connection 62 and 64 allow the direction of water flow in coil 50 to be selected according to the temperature of the incoming fresh air and the temperature of the cooling water in the circuit. Temperature sensors (not shown) are provided at appropriate parts of the circuit and in the duct 22 to control the various valves and pumps of the system, all as well known in the art.

As indicated above, heat energy transfer takes place between the cooling water in the coils 50 and 52 and the air passing through duct 22 when the cooling system is in use. If the temperature of the air entering the duct 22 is higher than the temperature of the cooling water (for example in summer) heat loss will take place from the air to the water; in other words, the coils will have a cooling effect on the incoming fresh air. On the other hand, if the temperature of the incoming air is lower than the temperature of the water, the air temperature will tend to increase and the water temperature will drop. By way of illustration, the drawing shows typical temperature conditons at different parts of the system for two different incoming air temperatures: 70° F and 30° F. At each location at which temperature is indicated, the top figure corresponds to an incoming air temperature of 70° F and the bottom figure corresponds to an incoming air temperature of 30° F.

It will be seen from the examples that, when the incoming air is at a temperature of 70° F, the colder water passing through coil 50 reduces the air temperature to 63° F and the temperature of the cooling water is increased to 62° F. After the water has passed through the chiller 44, its temperature is 42° F. In passing through the coil 52, the water temperature increases to 45° F as additional heat is transferred to the water from the air in duct 22. At the same time, the temperature of the air is further reduced to 60° F. When the incoming air temperature is 30° F the temperature of the water passing through coil 50 decreases from 45° F to 40° F and the temperature of the air increases to 35° F. At this temperature, it is not necessary to use the chiller 44. Accordingly, the water enters the coil 52 at 40° F. In passing through this coil, its temperature drops to 38° F and the temperature of the air is further increased to 37° F.

When the temperature of the incoming air is reasonably high say, above approximately 32° F, the cooling water is passed through coil 50 in the forward direction; i.e. from the first end 58 to the second end 60 for maximum heat exchange efficiency. However, at lower temperatures, the bypass connections 62 and 64 are used to reverse the direction of water flow through the coil; i.e. the water then flows from the second end 60 of the coil to the first end 58. In this situation, the water is delivered to the coldest end of the coil 50 first so that the temperature differential between the water and the air and hence the rate of heat loss from the water to the air are at their respective maxima at the coldest part of the coil. As the water passes along the coil, its temperature drops and the temperature of the air increases with the result that the temperature differential and hence the rate of heat loss from the water decreases. This avoids the problem of freezing of the coil within the ranges of water and air temperatures which can reasonably be expected to be encountered when the system is in use.

It will of course be appreciated that the preceding description applies to a specific embodiment of the invention and that modifications are possible within the broad scope of the invention.

For example, it may be possible to provide alternative fluid flow crossover means for reversing the direction of water flow through the precoil. The system need not include a second coil (52). Further the coil or coils need not be of the form shown in the drawing; the drawing is a diagrammatic illustration only. Also, although the invention has been described in connection with a cooling system in which water is used as the cooling fluid, the same principle may be used in systems employing other cooling fluids.

It should also be noted that although the preceding description refers only to a cooling circuit in an air conditioning system, such a system will normally (although not necessarily) include a heating system in order to provide a full range of temperature control.

What I claim is:

1. An air conditioning system for a building having a building cooling load, the system including:

a cooling circuit for a cooling fluid, the building cooling load being connected in said circuit and the circuit including: means for circulating the cooling fluid unidirectionally in the circuit and through the building cooling load; and means for cooling the fluid; and, means for delivering fresh air to the building, said means including: an inlet duct having an outer end communicating with ambient air outside the building; and means for drawing air into the building through the duct;

the cooling circuit further including: a heat transfer coil connected in said circuit upstream of the cooling means and defining a fluid flow path for said cooling fluid, the coil being arranged in said fresh air inlet duct so as to allow heat energy transfer between air in the duct and fluid in said coil, and the coil having respective first and second ends spaced longitudinally of the duct with said second end closer to said outer end of the duct than said first end; and, in said circuit, fluid crossover means associated with said coil and selectively operative to cause cooling fluid to flow through the coil either in a forward direction from said first end of the coil to said second end or in a reverse direction from said second end of the coil to said first end;

whereby, in conditions of low temperature ambient air, the fluid can be circulated through the coil in said reverse direction in order to minimize the overall heat loss from the cooling fluid to the incoming air as the fluid travels from end to end of the coil.

2. A system as claimed in claim 1, wherein said fluid flow crossover means comprise: two bypass connections extending from portions of said circuit upstream of the heat transfer coil to portions of the circuit downstream of said coil; and valve means associated with said connections and operable to cause fluid approaching said circuit to bypass the coil along one of said bypass connections, to flow in said reverse direction through the coil, and to return to the circuit downstream of said coil by way of said second bypass connection.

3. A system as claimed in claim 1, wherein said cooling fluid is water, and wherein said circuit includes water pipes along which the cooling fluid flows as it is circulated in the circuit and through the building cooling load, and wherein said means for cooling the fluid comprise a water chiller.

4. A system as claimed in claim 1, wherein the cooling circuit further includes a second heat transfer coil connected in said circuit downstream of the cooling means and arranged in said fresh air inlet duct downstream of the first heat transfer coil, whereby additional heat transfer can take place between the cooling fluid in said second coil and the incoming air in said duct.

5. In an air conditioning system for a building having a building cooling load, the system including:

means for delivering fresh air to the building said means including: an inlet duct having an outer end communicating with the ambient air outside the building; and means for drawing air into the building through the duct; and, a cooling circuit for a cooling fluid, the building cooling load being connected in said circuit and the circuit including: means for circulating the cooling fluid unidirectionally in the circuit and through the building cooling load; means for cooling the fluid; and a heat transfer coil connected in said circuit upstream of the cooling means and defining a fluid flow path for said cooling fluid, the coil being arranged in said fresh air inlet duct so as to allow heat energy transfer between air in the duct and fluid in said heat transfer coil;

the improvement wherein the heat transfer coil has respective first and second ends spaced longitudinally of the duct with said second end closer to said outlet end of the duct than said first end; and wherein said cooling circuit further includes fluid flow crossover means associated with said coil and selectively operable to cause cooling fluid to flow through the coil either in a forward direction from said first end of the coil to said second end, or in a reverse direction from said second end of the coil to said first end;

whereby, in conditions of low temperature ambient air, the fluid can be circulated through the coil in said reverse direction in order to minimize the overall heat loss from the cooling fluid to the incoming air as the fluid travels from end to end of the coil.

* * * * *